United States Patent [19]

Bernecker

[11] 4,164,525

[45] Aug. 14, 1979

[54] DEVICE FOR SUPPLYING FUEL TO AN INTERNAL COMBUSTION ENGINE

[75] Inventor: Gunther Bernecker, Montvale, N.J.

[73] Assignee: G.M.C. Research, Inc., Orange, N.J.

[21] Appl. No.: 841,872

[22] Filed: Oct. 13, 1977

[51] Int. Cl.[2] ..... F02M 11/00

[52] U.S. Cl. ..... 261/41 B; 261/44 A; 261/50 R; 261/71

[58] Field of Search ..... 261/50 R, 41 B, 44 A, 261/71, 50 A; 251/205, 206; 138/45, 45 A

[56] References Cited

U.S. PATENT DOCUMENTS

| | | | |
|---|---|---|---|
| 1,022,702 | 4/1912 | Rothe et al. | 261/41 B |
| 1,078,582 | 11/1913 | Jaugey | 261/41 B |
| 1,378,055 | 5/1921 | Pusey | 261/41 B |
| 2,070,598 | 2/1937 | Hewitson | 261/50 A |
| 2,313,366 | 3/1943 | Schwier | 261/41 B |
| 2,355,267 | 8/1944 | Boylan | 261/50 R |
| 2,445,104 | 7/1948 | Colvin | 138/45 |
| 3,514,074 | 5/1970 | Self | 251/205 |
| 3,959,418 | 5/1976 | Sullivan | 261/50 R |

FOREIGN PATENT DOCUMENTS

| | | | |
|---|---|---|---|
| 525781 | 9/1921 | France | 261/50 R |
| 508215 | 6/1939 | United Kingdom | 261/50 R |

*Primary Examiner*—Frank W. Lutter
*Assistant Examiner*—Gregory N. Clements
*Attorney, Agent, or Firm*—C. Bruce Hamburg

[57] ABSTRACT

A device for supplying fuel to an internal combustion engine comprises a shell, a tube received in the shell and a rod received in the tube with a sliding fit. A plurality of orifices in the tube at intervals along at least a portion of the length of the tube is provided. The rod is insertable in the tube to an extent sufficient to block the orifices and retractable to an extent sufficient to leave the orifices unobstructed. The number of orifices left unobstructed increases in proportion to the extent to which the rod is retracted. The rod includes means for connection to a linkage from a motor vehicle throttle for effecting axial movement of the rod. An annular space is defined between the exterior wall of the portion of the length of the tube having orifices and the portion of the length of the interior wall of the shell facing the orifices. Also provided are means defining passages for admitting liquid fuel into the annular space.

6 Claims, 4 Drawing Figures

DEVICE FOR SUPPLYING FUEL TO AN INTERNAL COMBUSTION ENGINE

BACKGROUND OF THE INVENTION AND PRIOR ART STATEMENT

This invention relates to a device for supplying fuel to an internal combustion engine. More particularly, this invention relates to an improved device for injecting fuel into the intake manifold of an internal combustion engine.

The prior art discloses in a number of instances the injection of fuel into the intake manifold or similar air intake conduit of an internal combustion engine. The prior art also discloses fuel injectors of numerous different constructions. Exemplary of such prior art, from all of which the present invention is patentably distinguishable, are the following U.S. patents.

U.S. Pat. Nos. 1,869,821, 1,931,541, 1,995,601, 2,089,989, 2,910,057 and 4,026,259 all disclose fuel supply devices for internal combustion engines in which the fuel is injected into an intake manifold or similar air supply conduit. Moreover, in some instances, a valve for controlling the air supply and means for controlling the flow rate through the fuel injection means are controlled by a common linkage from the throttle of the motor vehicle in which the internal combustion engine is installed. However, the fuel injection means in each instance are notably different from the device of the present invention which will hereinafter be described.

U.S. Pat. Nos. 3,702,175 and 3,982,694 are representative of the great diversity of constructions of fuel injection nozzles disclosed in the prior art. However, prior art fuel injection nozzles, such as those of these two patents, are notably different from the device of the present invention as will hereafter be described.

It is an object of the invention to provide a device for supplying fuel to an internal combustion engine which can serve as a replacement for a conventional carburetor without otherwise substantially altering the engine.

It is a further object of the invention to provide a device for supplying fuel to an internal combustion engine which is substantially simpler and less expensive than conventional carburetors and fuel injection systems.

It is yet a further object of the invention to provide a device for supplying fuel to an internal combustion engine which results in higher gas mileage and a lower level of pollutants in the exhaust gases than a conventional carburetor or fuel injection system.

Other objects and advantages of the invention will be apparent from the following description thereof.

BRIEF DESCRIPTION OF THE INVENTION

According to the invention, there is provided a device for supplying fuel to an internal combustion engine comprising a shell, a tube received in the shell and a rod received in the tube with a sliding fit. A plurality of orifices are provided in the tube at intervals along at least a portion of the length of the tube. The rod is insertable in the tube to an extent sufficient to block the orifices and retractable to an extent sufficient to leave the orifices unobstructed. The number of orifices left unobstructed increases in proportion to the extent to which the rod is retracted. The rod includes means for connection to a linkage from a motor vehicle throttle for effecting axial movement of the rod. An annular space is defined between the exterior wall of the portion of the length of the tube having orifices and the portion of the length of the interior wall of the shell facing the orifices. Means are providing defining passages for admitting liquid fuel into the annular space. The fuel is ejected from the device solely through the annular space when the rod is inserted in the tube to an extent sufficient to block the orifices. Some of the fuel also passes from the annular space through the orifices to the interior of the tube from whence the fuel is ejected from the device when the rod is retracted to an extent sufficient to leave orifices unobstructed. The volumetric flow of the fuel into and through the tube increases as the number of orifices left unobstructed is increased by increasing the retraction of the rod.

The device as hereinabove defined is to be used in combination with means for admitting air to the intake manifold of an internal combustion engine, the air admitting means including means defining a passage for the air and a valve for controlling passage of the air through the air passage. There is also provided a common linkage to the valve and the rod for simultaneously opening the valve and retracting the rod and simultaneously closing the valve and inserting the rod, the linkage including means for connection to a motor vehicle throttle.

In practice, the device is intended to be used on the intake manifold of the engine, in the same position as a conventional carburetor, for supplying fuel and air to the intake manifold.

DETAILED DESCRIPTION OF A PREFERRED EMBODIMENT

Figure 1:
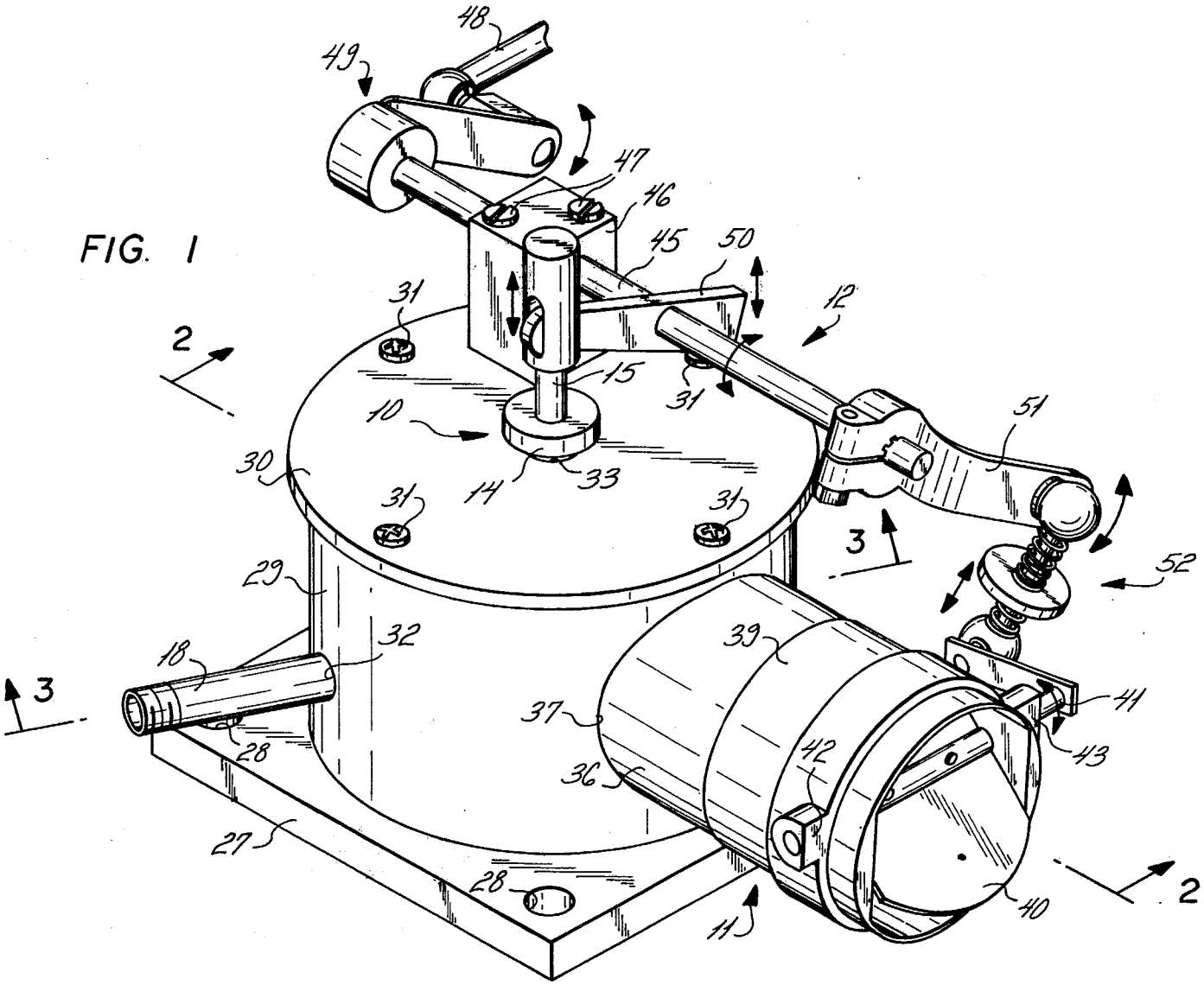
FIG. 1 is an isometric view of a device according to the invention for taking the place of a conventional carburetor.
Figure 2:
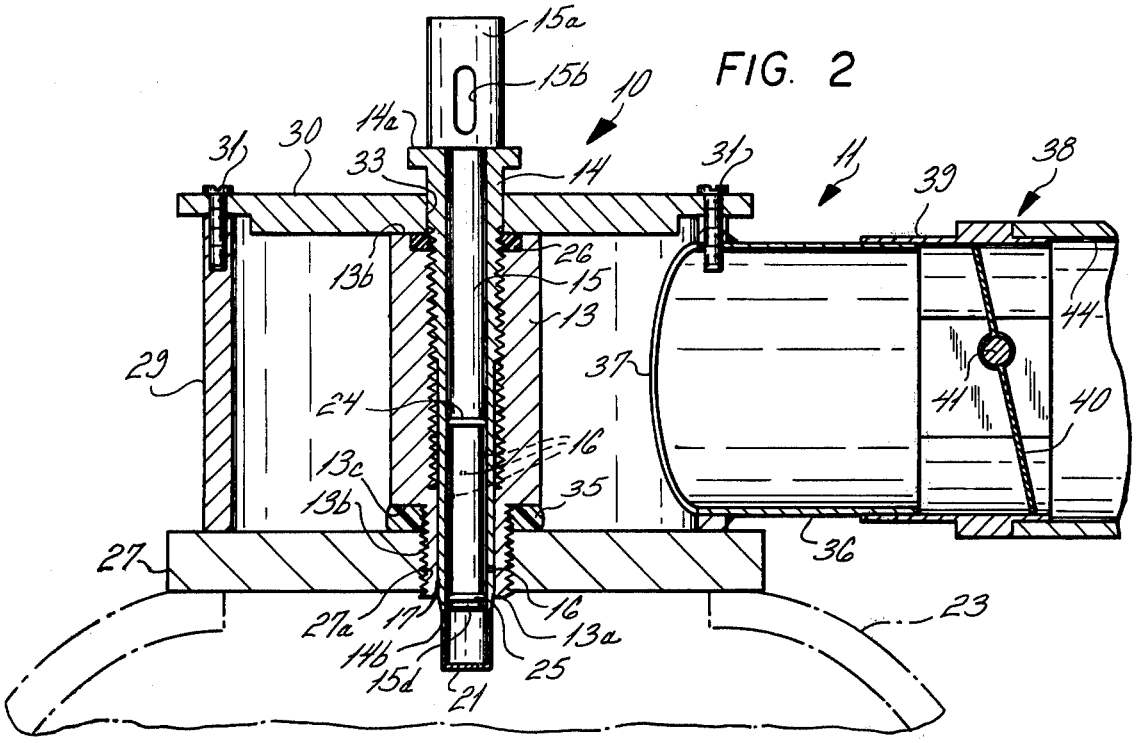
FIG. 2 is a cross section taken on section line 2—2 of FIG. 1, but with the device installed on an intake manifold shown in phantom.
Figure 3:
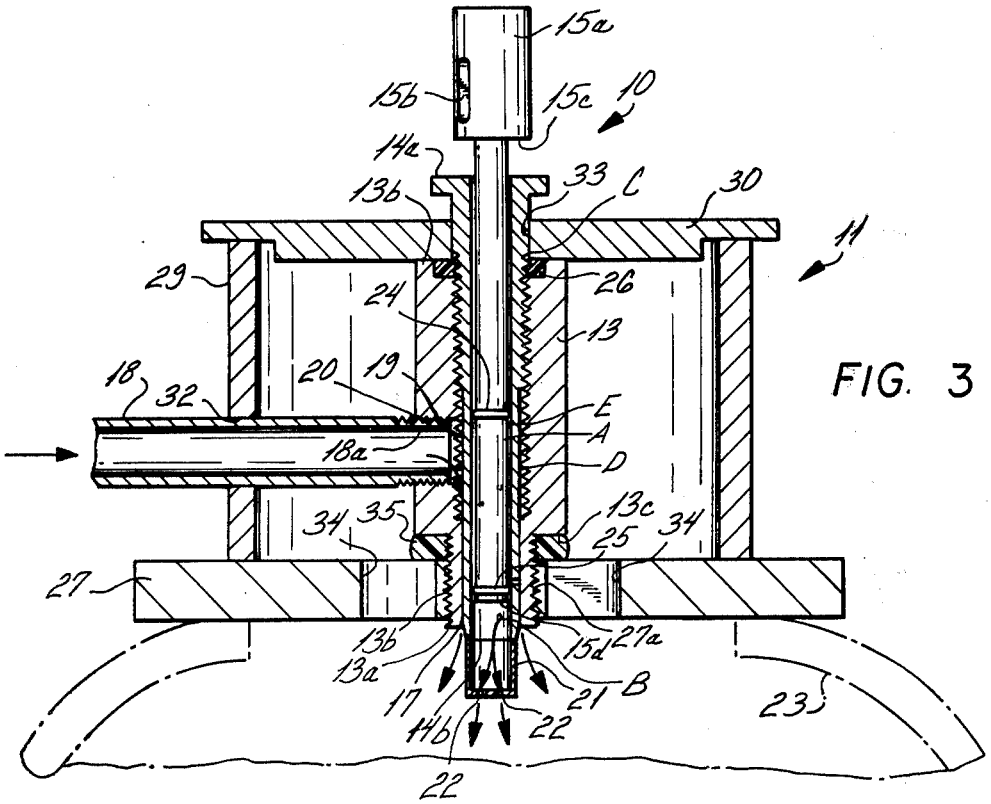
FIG. 3 is a cross section taken on section line 3—3 of FIG. 1, but with the device installed on an intake manifold shown in phantom.

The combination apparatus shown in FIGS. 1–3 is fundamentally a combination of a fuel supply device 10 and air supply means 11 simultaneously controlled by a common linkage 12. The linkage 12 is "common" in the sense that it is shared by the fuel supply device 10 and air supply means 11.

The fuel supply device 10 includes a shell 13, a tube 14 received in the shell 13 and a rod 15 received in the tube 14 with a sliding fit. A plurality of orifices 16 is provided in the tube 14 at intervals along at least a portion of the length of the tube 14. In particular, the orifices are in a helical array of 360° extending from level A to level B of the tube 14. The rod 15 includes means **15*a* for connection to a linkage from a motor vehicle throttle. In particular, the connection means 15*a* is an upper portion of the rod 15 of enlarged diameter in which is provided a slot 15*b* for receiving an end of a lever of the linkage. The lower part of the means 15*a* also provides a shoulder 15*c* for abutting against the upper end 14*a* of the tube 14 thereby to limit downward sliding of the rod 15 into the tube 14. With reference to FIG. 2, it is seen that when the shoulder 15*c* of the rod 15 is abutting against the upper end 14*a* of the tube 14, the lower end 15***d* of the rod 15 and the lower end 14*b* of the tube 14 meet. It is also seen in FIG. 2 that with the rod 15 thus fully inserted in the tube 14, the rod 15 is blocking all the orifices 16 in the tube 14. With reference to FIG. 3, it is seen that as the rod 15 is progressively retracted from the tube 14, and in particular as the lower end 15*d* of the rod 15 rises above level B of the tube 14, first the lowermost of the orifices 16 at level B and then, in addition, orifices at higher level are, one by one, left unobstructed. Hence, the number of orifices 16 left unobstructed increases in proportion to the extent to which the rod 15 is retracted.

Figure 4:
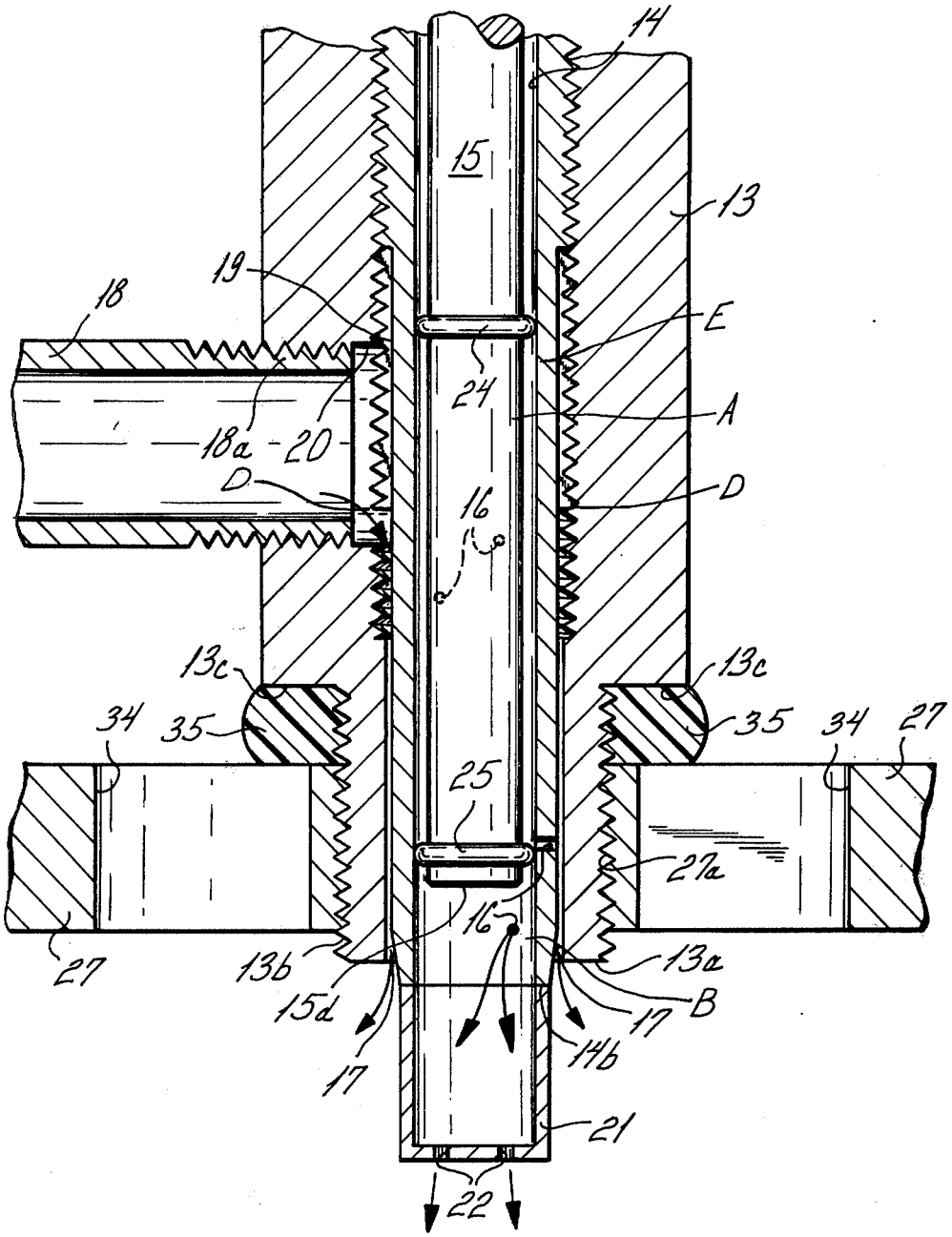
FIG. 4 is an elargement of a portion of FIG. 3.

An annular space 17, which is too small to actually clearly appear in FIGS. 2 and 3, but which does appear in FIG. 4 due to the enlarged nature of this illustration, is defined between the exterior wall of the portion A to B of the length of the tube having orifices 16 and the portion of the length of the interior wall of the shell 13 facing the orifices 16. The annular space 17 is merely the result of the external diameter of the tube 14 being slightly smaller than the internal diameter of the shell 13. Also provided are means 18 and 19 defining passages for admitting liquid fuel into the annular space 17. In particular, the means 18 is a fuel supply line, and the means 19 is a flat milled onto the surface of the tube 14. The tube 14 is externally threaded and the shell 13 is internally threaded from level C to level D. Thus, the tube 14 is screwed into the shell 13. A radial bore 20 is provided through a wall of the shell 13. The radial bore 20 is internally threaded. An end portion 18*a* of the fuel supply line 18 is externally threaded. Consequently, the fuel supply line 18 is screwed into the bore 20. The flat 19 extends from level E, i.e., approximately at the top of the internal diameter of the fuel supply line 18 to level D, i.e., the lower end of the threads. Thus, the flat 19 communicates between the fuel supply line 18 and the annular space 17, which extends from level D to the level of the lower end 13*a* of the shell 13. In practice, a plurality, for example, four or five, identical flats 19 are provided around the circumference of the tube 14 to assure that one of these flats 19 is in alignment with the bore 20 regardless of the angular displacement of the tube 14 relative to the shell 13.

From the foregoing, it can readily be seen that at all times that fuel is flowing through the fuel supply line 18, fuel will flew into the annular space 17 due to communication from the fuel supply line 18 to the annular space 17 by means of a flat 19. The fuel which flows through this path exits from the device 10 at the juncture of the tube 14 and the shell 13 at the lower end 13*a* of the shell 13 as a spray which is in a frustoconical configuration emanating from the aforesaid juncture. This takes care of the fuel requirements of the engine when idling.

As the driver depresses the throttle, through a mechanical linkage which will hereinafter be described, axial movement is imparted to the rod 15 which retracts the rod 15 from the tube 14. Hence, a progressively increasing number of orifices 16 is left unobstructed. The orifices 16 communicate between the annular space 17 and the interior of the tube 14. Hence, some of the fuel also flows through the orifices 16 into the interior of the tube 14. Fastened onto the lower end 14*b* of the tube 14 is a spray cap 21 having orifices 22. The fuel which flows to the lower end 14*b* of the tube 14 enters the spray cap 21 and exits the cap through the orifices 22 in the form of a spray. All the while, fuel continues to be sprayed in the other mode, too. The further the rod 15 is retracted, the greater the rate at which fuel is supplied to the engine and, consequently, the more the vehicle accelerates. The fuel is sprayed into the intake manifold 23 of the engine. The rod is provided with a pair of O-rings 24 and 25 seated in respective annular grooves in the rod 15. When the rod 15 is fully inserted in the tube 14, the O-ring 24 is slightly above the highest orifice 16 and the O-ring 25 is slightly below the lowerest orifice 16. When the rod lowest is retracted to the maximum extent effected by the linkage from the throttle, the O-ring 25 is in about the same position as the O-ring 24 was in when the rod 15 was fully inserted in the tube 14. The O-rings 24 and 25, hence, prevent fuel vapors from seeping upwardly out of the fuel supply device 10. To this same end, an O-ring 26 is provided in an annular recess 27 provided in the upper end 13*b* of the shell 13. The interior surfaces of the O-ring 26 are in contact with the outer face of the tube 14 and, hence, the O-ring 26 prevents the seepage of fuel fumes upwardly out of the device 10 through the interface of the internal threads of the shell 13 and the external threads of the tube 14.

The fuel supply device 10 and air supply means 11 are mounted in a housing which constitutes part of the air supply means. The housing includes a base plate 27 having a hole 28 bored through each of its corners for mounting onto the top of an intake manifold 23 in the same manner as a conventional carburetor, which the present invention replaces. The housing is further constituted of a cylindrical side wall member 29 and a disc-shaped cover 30. The cover 30 is releasably held onto the cylindrical side wall member 29 by means of four screws 31. The fuel supply line 18 passes through a bore 32 provided in the cylindrical side wall member 29. The tube 14 passes through a bore 33 provided through the center of the cover 30. The O-ring 26, which seals off the escape of fuel from the interface of the internal threads of the shell 13 and the external threads of the tube 14, also prevents the escape of fuel vapors through the interface of the bore 33 and the upper portion of the tube 14. The lower portion of the shell 13 is provided with external threads 13*b*. The base plate 27 is provided with openings 34 communicating between the interior of the housing of the device according to the invention and the interior of the intake manifold 23. Through the remaining central area 27*a* of the base plate 27 is provided an internally threaded bore into which the externally threaded lower end of the shell 13 is screwed. An O-ring 35 is provided at the shoulder 13*c* of the shell 13 situated immediately above the threaded portion of the shell 13. The O-ring 35 is also in contact with the base plate 27 and seals off the interface of the external threads 13*b* of the shell 13 and the internal threads provided in the bore through the central portion 27*a* of the base plate 27. An air inlet conduit 36 communicates with the interior of the housing through an opening 37 in the side wall member 29. Communicating with the air inlet conduit 44, for controlling the flow of air therethrough, is a butterfly valve assembly 38. The butterfly valve assembly comprises a section of conduit 39 in which a butterfly valve 40 is mounted on a pivot pin 41 which is received in journal bearings 42,43 on the walls of the conduit section 39. Additional air inlet conduit 44 may be provided on the upstream side of the butterfly valve assembly 38. The conduit 44 may communicate with a conventional automotive air filter at the location of which air first enters the air intake system of the motor vehicle.

The linkage 12 includes a shaft 45 which is journalled in a block 46 fastened to the cover 30 by means of screws 47. A rod 48 extends from the throttle (not illustrated) to a crank assembly 49 connected to one end of the shaft 45. Fastened to the shaft 45 at an intermediate point is a lever 50. The lever 50 engages the rod 15 by being received in the slot **15*b* in the rod 15. To the other end of the shaft 45 is connected a lever 51 which, in turn, is pivotally connected to crank assembly 52 which it actuates. With reference to FIG. 1, it is seen that pushing the rod 48 toward the crank assembly 49 by means of depressing the throttle causes the crank assembly to angularly displace in the clockwise direction, thereby angularly displacing the shaft 45 in the clockwise direction, which causes the lever 50 to lift the rod 15 and causes the lever 51 and crank assembly 52 to open the butterfly valve 40 thereby to effect the simultaneous introduction of air and increased quantities of fuel into the intake manifold 23, resulting in acceleration of the engine. As usual, the throttle is provided with a spring, so that when one takes one's foot off the throttle, the rod 48 will move away from the crank assembly 49, thereby causing the lever 50 to push the rod 15 down again and the lever 51 and crank assembly 52 thereby to close the butterfly valve 40** again, resulting in deceleration of the engine.

While the invention has been described by reference to a specific, preferred embodiment thereof, it is to be understood that modifications and variations thereof which would be obvious to one skilled in the art are intended to be encompassed within the scope of the hereto appended claims.

What I claim is:

1. A carburetor for supplying a fuel/air mixture to an internal combustion engine including a fuel ejecting device comprising a shell, a tube received in the shell and a rod received in the tube with a sliding fit, a plurality of orifices in the tube at intervals along at least a portion of the length of the tube, the rod being insertable in the tube to an extent sufficient to block the orifices and retractable to an extent sufficient to leave the orifices unobstructed, the number of orifices left unobstructed increasing in proportion to the extent to which the rod is retracted, the rod including means for connection to a linkage from a motor vehicle throttle for effecting axial movement of the rod, an annular space defined between the exterior wall of the portion of the length of the tube having orifices and the portion of the length of the interior wall of the shell facing said orifices, and means defining passages for admitting liquid fuel into the annular space, whereby the fuel is ejected from the device solely through the annular space when the rod is inserted in the tube to an extent sufficient to block the orifices and some of the fuel also passes from the annular space through the orifices to the interior of the tube from whence the fuel is ejected from the device when the rod is retracted to an extent sufficient to leave orifices unobstructed, the volumetric flow rate of the fuel into and through the tube increasing as the number of orifices left unobstructed is increased by increasing the retraction of the rod, and air admitting means for admitting air into admixture with the ejected fuel.

2. The carburetor according to claim 1, in which the air admitting means includes means defining a passage for the air and a valve for controlling passage of the air through the air passage.

3. The combination of a carburetor according to claim 2 and an internal combustion engine intake manifold, the fuel ejecting device and the air admitting means communicating with the interior of the intake manifold for the simultaneous injection of fuel and admission of air into the intake manifold.

4. The carburetor according to claim 2, further comprising a common linkage to the valve and the rod for simultaneously opening the valve and retracting the rod and simultaneously closing the valve and inserting the rod, the linkage including means for connection to a motor vehicle throttle.

5. The combination of a carburetor according to claim 4 and an internal combustion engine intake manifold, the fuel ejecting device and the air admitting means communicating with the interior of the intake manifold for the simultaneous injection of fuel and admission of air into the intake manifold.

6. The combination of a carburetor according to claim 1 and an internal combustion engine intake manifold, the fuel ejecting device projecting into the interior of the intake manifold for the injection of fuel through the device into the intake manifold.

* * * * *

UNITED STATES PATENT AND TRADEMARK OFFICE

CERTIFICATE OF CORRECTION

PATENT NO. : 4,164,525

DATED : August 14, 1979

INVENTOR(S) : Gunther Bernecker

It is certified that error appears in the above-identified patent and that said Letters Patent are hereby corrected as shown below:

Column 2, line 41, after "phantom" insert --; and-- and delete the period.

Column 3, line 46, after "will" change "flew" to --flow--.

Column 4, line 8, after "rod" delete "lowest" and insert --15--.

Signed and Sealed this

*Nineteenth* Day of *February 1980*

[SEAL]

*Attest:*

SIDNEY A. DIAMOND

*Attesting Officer*

*Commissioner of Patents and Trademarks*